United States Patent [19]

Tripler

[11] 4,175,478

[45] Nov. 27, 1979

[54] EXPANSIBLE GUSSET ENVELOPE AND METHOD AND APPARATUS FOR FABRICATING SAME

[75] Inventor: John G. Tripler, La Mirada, Calif.

[73] Assignee: American Fiber Velope Manufacturing Co., Collingdale, Pa.

[21] Appl. No.: 886,331

[22] Filed: Mar. 13, 1978

[51] Int. Cl.[2] ..... B31B 29/26

[52] U.S. Cl. ..... 93/62; 93/13

[58] Field of Search ..... 93/62, 13

[56] References Cited

U.S. PATENT DOCUMENTS 4,016,808 4/1977 Young ..... 93/62

*Primary Examiner*—Z. R. Bilinsky

*Attorney, Agent, or Firm*—Stanley Bilker

[57] ABSTRACT

Expansible gusset envelope and method and apparatus for fabricating same from a single blank by inwardly, next outwardly, and then inwardly folding bottom gusset sections along triple transverse score lines to bring a first panel hinged thereto into overlying disposition with a second panel. Thereafter, side flaps are glued to the first panel by inwardly, then outwardly, and next inwardly folding side gusset sections hinged to the second panel along triple longitudinal score lines. Triangular corner tabs hinged to the side gusset sections are glued to congruent triangular portions at the margins of the bottom gusset sections by opening break-away flaps at the margins of the first panel between steps (1) and (2) to expose the triangular portions preparatory to tucking in of the corner tabs whereby all gussets are inwardly collapsed with closed corners at completion.

9 Claims, 19 Drawing Figures

FIG. 2
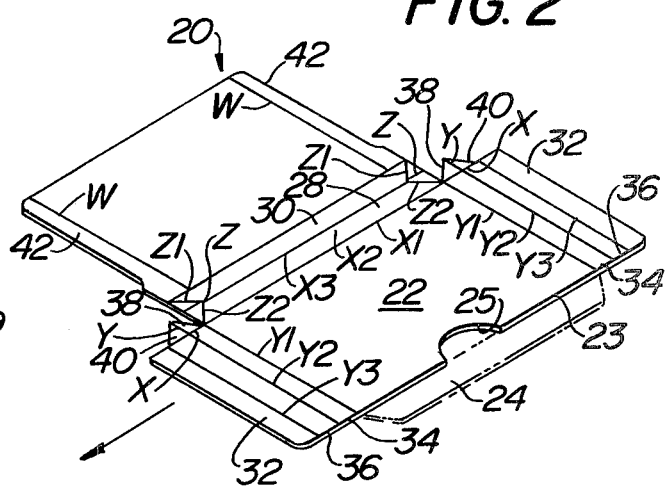
FIG. 3
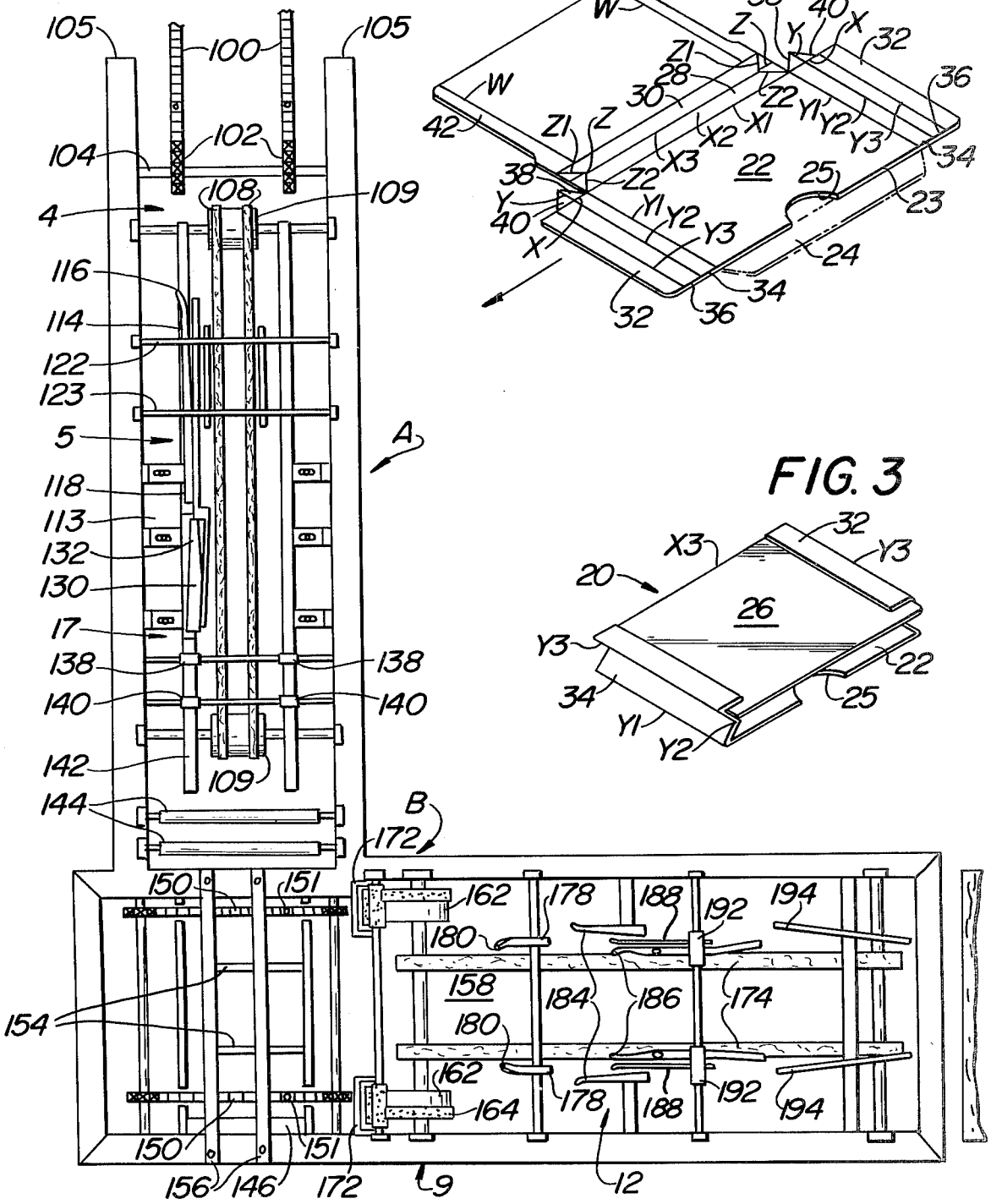
FIG. 1

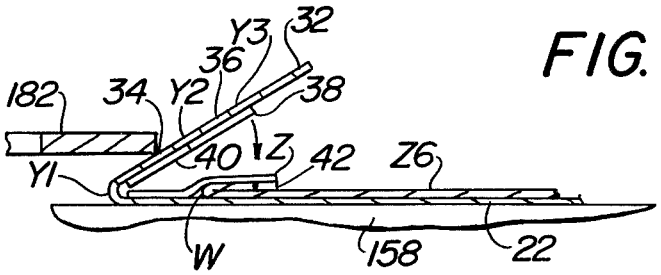
FIG. 15
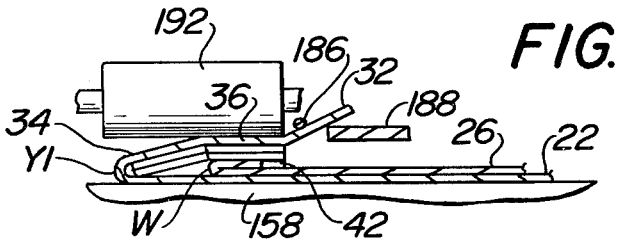
FIG. 16
FIG. 17
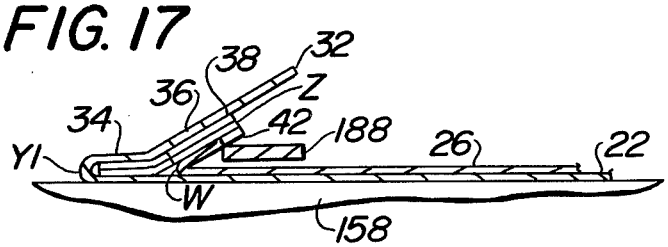
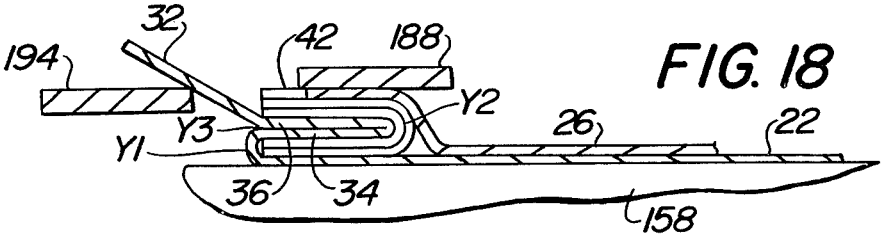
FIG. 18
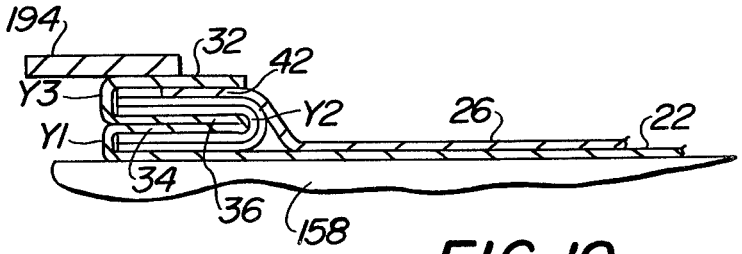
FIG. 19

EXPANSIBLE GUSSET ENVELOPE AND METHOD AND APPARATUS FOR FABRICATING SAME

SUMMARY OF THE INVENTION

This invention relates to a new and improved expansible gusset envelope and a method and apparatus for fabricating such an envelope from a single blank. More particularly, the present invention concerns a gusseted envelope in which all side and bottom gusset panels are interiorly folded in collapsed disposition at the completion of a predetermined sequence of folding and gluing operations which may be performed by hand but preferably by automatic machinery. The herein-employed blank utilizes sheet stock of minimal dimensions and produces a completed configuration adapted for use either as a file folder or mailer. The completed envelope either may embody a symmetrical external side seam design or an exposed center seam orientation with fully closed gusseted corners in either collapsed or expanded condition.

In particular, the blanks with which this invention is concerned includes a pair of panels hinged together through a pair of bottom gusset sections defined between transverse triple score lines and side flaps hinged to the lateral margins of one of the panels through side gusset sections defined between longitudinal triple score lines. Each side gusset section in the blank includes a triangular corner tab hinged thereto along the line registering with the first of three transverse score lines and hinged to each other along a line registering with the medial longitudinal fold line to define an isosceles triangle whose apex terminates at a point coextensive with the medial transverse score line. A congruent isosceles triangle is scored at the outer margins of the bottom gusset sections, the apices of these later triangles lying on the medial transverse score line and pointing toward each other. The lateral margins of the second panel are scored along a line intersecting with the apices of the scored triangular portions and terminate thereat to define break-away flaps.

By way of a hand or, preferably, automatic machinery, the aforesaid blanks are inwardly, next outwardly, and then inwardly again folded along the inboard, medial, and outboard score lines respectively until the second panel is in overlying disposition with the first panel and the depending triangular tabs overlie the lower margins of the side gusset sections. At this stage or immediately subsequent the next step, glue is applied to the now upward facing surface of the triangular tabs and to the upper (inner) surface of the side sealing flaps. The break-away flaps are next folded outwardly along their respective scores to open up and expose the isosceles triangular portions of the bottom gusset sections so that they lie exposed and in side by side disposition with the isosceles triangular tabs. Now by inwardly folding the side gusset sections along the inboard longitudinal fold line, the triangular tabs are brought into adherent engagement with the isosceles triangular portion. The side sealing flaps are then folded outwardly along the medial transverse score line drawing the break-away flaps along with them, by virtue of the adhering abutting triangular portions, into overlying disposition with the outboard side gusset sections. Finally, the side sealing flaps are folded inwardly along the outboard longitudinal score line until they are in sealed adherent disposition with the break-away flaps and the adjacent margins of the second panel.

BACKGROUND OF THE INVENTION

Originally, expansible full panel envelopes with gusseted side and bottom panels required a separate and independent procedure to tuck in the bottom gusset during fabrication. See for example, U.S. Pat. No. 2,899,874 wherein an additional step was necessary to crush in the bottom gusset after completion of the operations.

In prior U.S. Pat. Nos. 3,414,185, 3,552,640, and, 3,860,164, there are illustrated respectively a center seam, a side seam and a full panel expansible gusset envelope in which all side and bottom gussets are inwardly folded upon the completion of automatic machinery operations. However, each of these envelopes, as a result of their blank design and the operational steps of fabrication, were somewhat deficient in that the junctures at the corners were not entirely closed at the completion of assembly. As a consequence, small articles, such as pencils, pens, clips and the like, had a tendency to fall through the partially sealed openings at the gusset corners produced by these envelope constructions.

In prior U.S. Pat. No. 4,016,808, there is shown a method and apparatus for making an expansible gusset envelope from a blank in which the corner gusset tabs had to be crimped or crushed inwardly during a phase of the operation in order to form a saddle preparatory to tucking therein the outer margins of the bottom gusset wall for sealing. While this design produced an expansible envelope having all gussets inwardly collapsed at the close of operations and wherein the corners were fully closed and sealed, the crimping step performed by high speed machinery had a tendency to throw a fair percentage of the moving blanks out of line. This in turn produced an unwanted number of rejects by virtue of unintentional creases and glue applications out of true registration.

It is therefore an object of this invention to provide an envelope blank and a method an apparatus for forming said blank into an expansible envelope having fully closed corners and with all gussets interiorly collapsed at the completion of operations.

Another object of this invention is to provide a method and apparatus for forming an expansible gusset envelope from a single blank by way of operations that produce very low shrinkage rates.

Other objects of this invention are to provide an improved method of the character described that is easily and economically produced, sturdy in construction, and highly efficient and effective in operation.

DESCRIPTION OF THE FIGURES

With the above and related objects in view, this invention consists of the details of construction and combination of parts as will be more fully understood from the following detailed description when read in conjunction with the accompanying drawings in which:

FIG. 1 is a plan view of an expansible gusset envelope fabricating machine embodying this invention.

FIG. 2 is a plan view of the envelope blank embodying this invention and which is adapted to be formed by the apparatus and method of this invention into an expansible gusset envelope.

FIG. 3 is a perspective view of the completed envelope formed from the blank of FIG. 2.

FIG. 15 is a sectional view taken along lines 15—15 of FIG. 14.

FIG. 16 is a sectional view taken along lines 16—16 of FIG. 14.

FIG. 17 is a side sectional view taken generally at the position designated by the arrow 17 in FIG. 1 as the envelope blank advances from position 14.

FIG. 18 is a side sectional view of the envelope blank preliminary to folding back of the side flaps.

FIG. 19 is a side sectional view taken generally at the side flap sealing station designated by the arrow 19.

DETAILED DESCRIPTION

Figure 4:
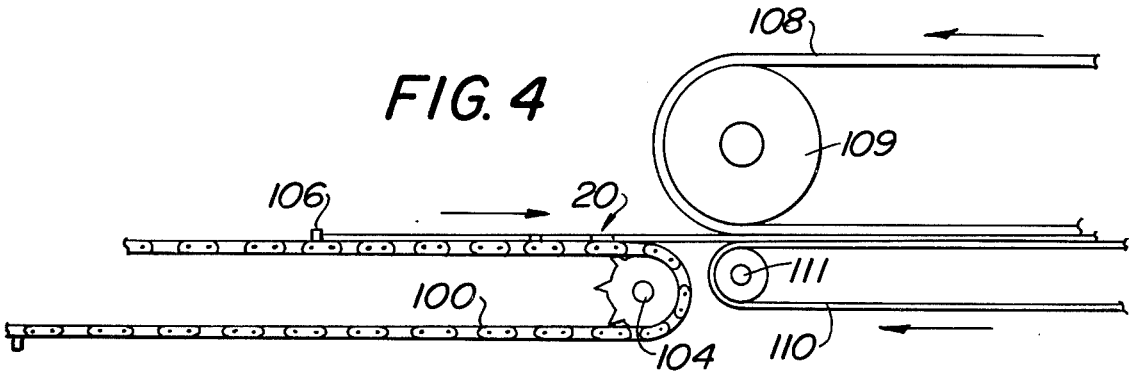
FIG. 4 is a side view of a feeding mechanism of this invention taken generally at the position designated by the arrow 4 in FIG. 1.

Referring now in greater detail to the drawings in which similar reference characters refer to similar parts, a preferred embodiment of the expansible gusset envelope with which the present invention is concerned is shown in blank form 20 in FIG. 2 and in fabricated assembled form in FIG. 3. The blank 20 has a first panel 22 which will constitute either a front wall when used as a mailer, in which case a top sealing flap 24 may be hinged thereto along fold line 23, or a back panel when used as a file folder, in the latter case flap 24 being adapted to act as an indicia bearing extension for identifying the folder's contents. In the event that flap 24 is not employed, a cut-out 25 may be incorporated to facilitate removal of the folder documents. A second panel 26 is hinged to the bottom of the first panel 22 along transverse triple score lines X1, X2, and X3 between which are defined a pair of bottom gusset sections 28 and 30 that comprise a collapsible bottom wall. A side sealing flap 32 is hinged to each of the lateral edges of the first panel 22 along longitudinally extending triple score lines Y1, Y2 and Y3 which define a pair of side gusset sections 34 and 36 that constitute collapsible side walls in the completed envelope. Triangular corner gusset tabs 38 and 40 are hinged to the bottom of each of the side gusset sections 34 and 36 along extensions X of the first transverse score line X1. The corner tabs 38 and 40 are further hinged to each other along fold line Y which is an extension of the medial longitudinal score line Y2, said hinged corner tabs forming isosceles triangles which are adapted to be sealed in registering abutment with the corresponding isosceles triangles scored in the bottom wall along diagonal fold lines Z. The second panel 26 further includes score lines W at the lateral margins thereof in alignment with the apices of the isosceles triangles Z to define break-away portions 42. These break-away panels 42 are bent back temporarily during the sequence of the folding operations to expose the triangular portions Z and allow the triangular tabs 38–40 to be tucked therein and sealed thereto whereby a strong close gusset corner is formed at each of the side walls at their intersection with the bottom wall. When the blank 20 is formed into the complete envelope by means of the method or apparatus of the instant invention, the second panel 26 is folded into overlying disposition with the first panel 22 while the side sealing flaps 32 are glued to the exterior lateral margins of the first panel. In addition, the corner tabs 38 and 40 are glue to the interior outboard margins of the bottom gusset sections 28 and 30 while all gussets are inwardly folded in collapsed disposition.

Throughput this description, an inward fold line refers to a folding of the blank toward the upper face of the plane of the paper while an outward fold refers to a folding of the blank away from said upper surface.

Figure 5:
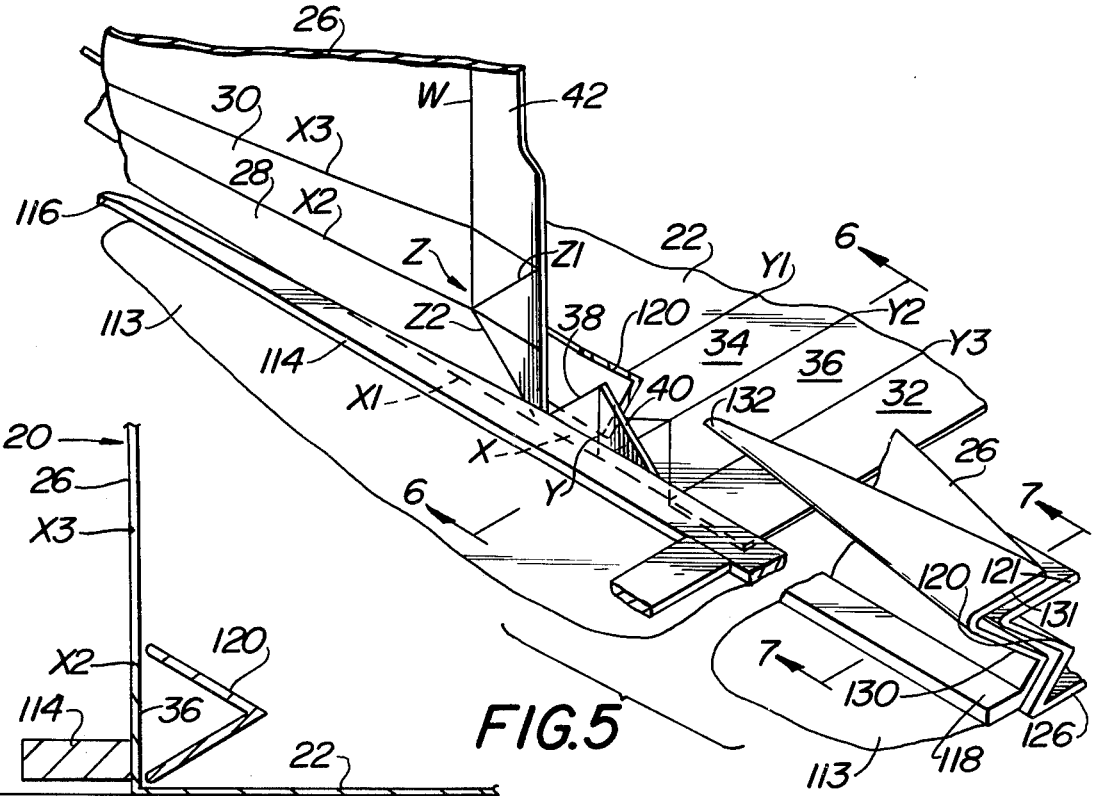
FIG. 5 is a fragmentary perspective view of the initial folding section of this invention taken generally at the position designated by the arrow 5 in FIG. 1.

The method for forming the blank 20 into the completed envelope involves the following steps:

As shown in FIG. 5, the second panel 26 is first inwardly folded along transverse score lines X1, next outwardly folded along transverse score line X2 and then inwardly folded along transverse line X3 such that the bottom gusset sections 28 and 30 are interiorly collapsed in abutment with each other with the second panel 26 in overlying disposition with the first panel 22. In addition, the triangular corner tabs 38 and 40 are likewise folded back into overlying relation with the lower margins of the side gusset sections 34 and 36. At this stage, triangular portions Z are folded in half along score line X2 with diagonal lines Z1 and Z2 overlying each other.

Figure 12:
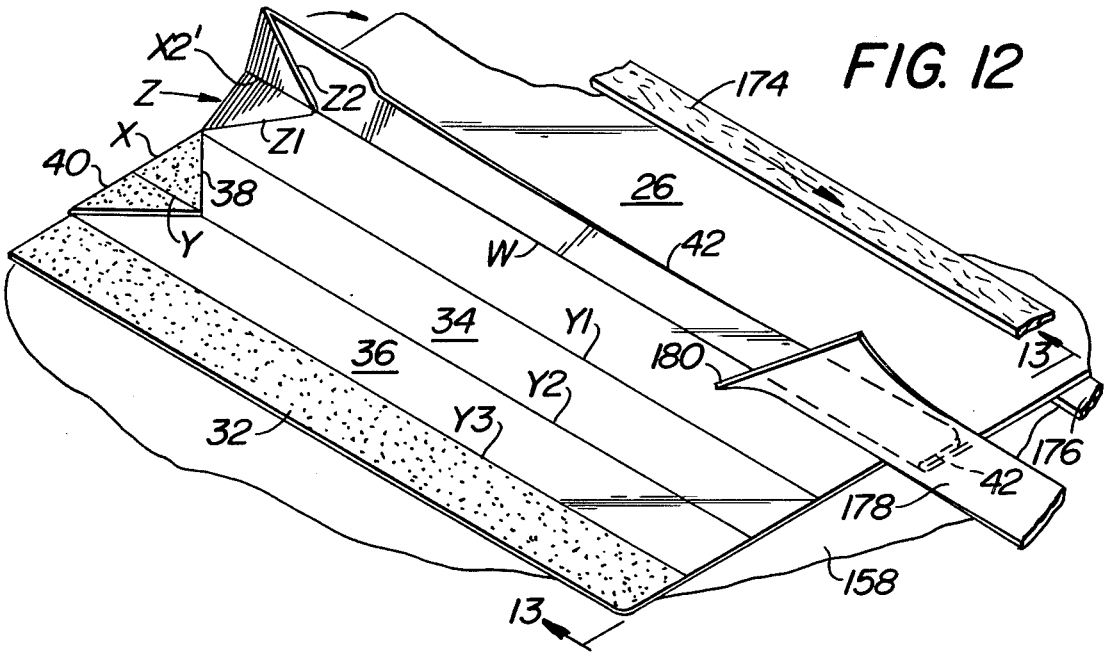
FIG. 12 is a fragmentary perspective view of the envelope blank as it appears at the corner saddle exposing station taken generally at the position designated by the arrow 12 in FIG. 1 wherein the side seam is opened up preliminary to tucking in the corner tabs.

Referring to FIG. 12, the break-away panels 42 are each folded outwardly along score line W thereby causing the portion X2′ of intermediate score line X2 to be urged normal to score line X2 while diagonal scores Z1 and Z2 are fanned apart. When panel 42 is pressed flat against panel 26, isosceles triangles 38–40 and Z are in side by side disposition with altitudes Y and X2′ parallel. In this orientation, triangle Z is exposed for tucking in and glueing thereto of the triangular corner tabs 38–40. Glue may be applied to the corner tabs 38–40, and to the side flaps 42 (or the glue may have been applied immediately prior to this step).

Figure 14:
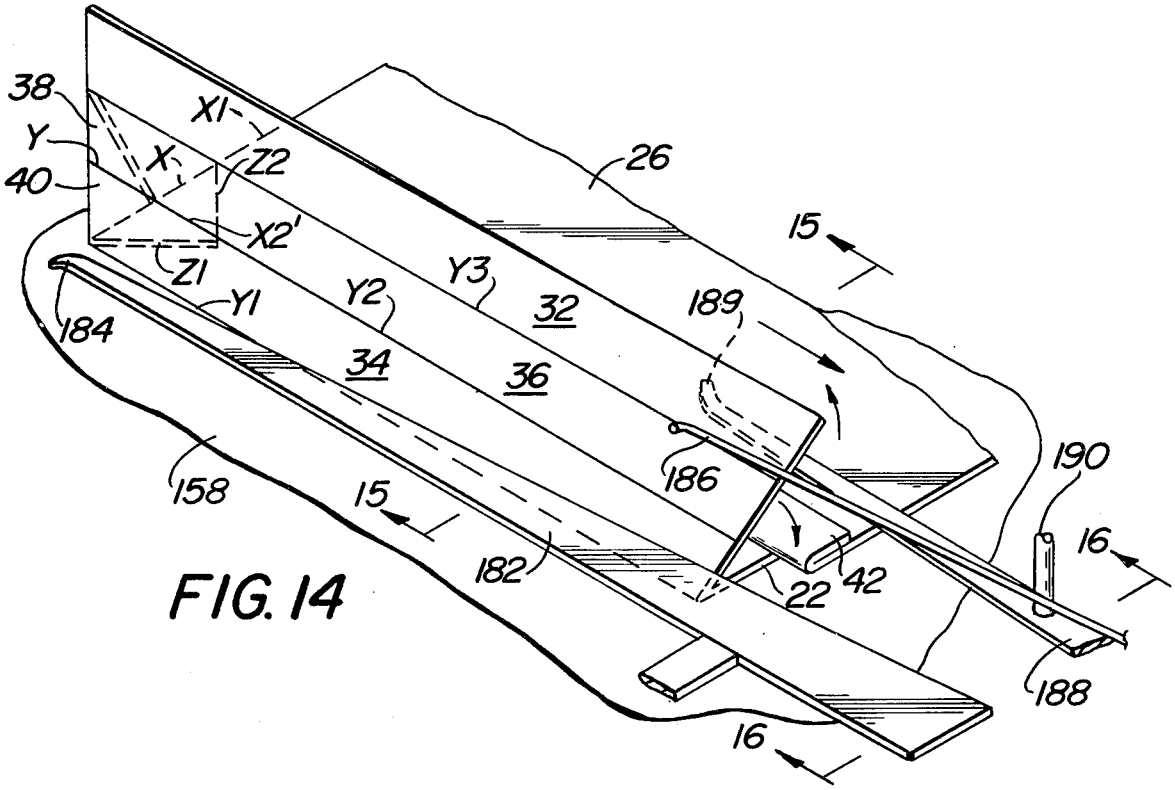
FIG. 14 is a fragmentary perspective view of the side folding and corner gusset tucking section taken generally at the position designated by the arrow 14 in FIG. 1.

Referring now to FIGS. 14 and 15, the side gusset sections 34 and 36 along with side sealing flaps 32 are inwardly folded along longitudinal score line Y1 and the corner tabs 38–40 are pressed into sealed disposition with isosceles triangles Z, as shown in FIG. 16. It is to be observed from FIG. 16 that side sealing flaps 32 are held from touching the break-away flaps 42 at this stage since only the interior surfaces of latter are now exposed.

Referring next to FIG. 17, the outboard side gusset section 36 (along with side sealing flap 32) is folded outwardly along medial longitudinal score line Y2. Since the corner gusset tabs 36–38 are adhered to the corresponding triangular portions Z, the break-away flaps 42 are caused to hinge outwardly along score line W to expose the outer surfaces of said flaps.

Finally, as shown in FIGS. 18 and 19, the side sealing flaps 32 are folded inwardly along outboard longitudinal score line Y3 and sealed in abutment with the external surface of second panel 26 including the outer surface of break-away flap 32.

Referring now to FIG. 1, the apparatus of the present invention comprises a frame of generally L-shaped plan configuration having a first section A in which the envelope blank 20 is folded inwardly, next outwardly, and then inwardly again along the transverse score lines X1 (including line X), X2 and X3, and a second section B in which the blank changes direction of travel and is folded inwardly, next outwardly and then inwardly again along the longitudinal score lines Y1, Y2 (including line Y) and Y3. The second section includes a station (at 12) for outwardly folding the break-away flap 42 along score line W to break open and expose the triangular portions Z at the outer margins of the bottom gusset sections preparatory to tucking in and sealing the corner gusset tabs 38 and 40 thereto when the inward fold along Y1 is made. See FIGS. 12, 13, 14, 15 and 16. The second section B (transfer section) also includes a glue application station (at 9) for laying down a seam of cement on the triangular tabs 38 and 40 as well as upon side sealing flaps 32 (see FIGS. 9, 10 and 11) immediately before the break-away flap 42 is opened to expose the triangular portions Z.

Referring now to FIG. 4, the envelope blanks 20 are successively fed into the first section A by means of a pair of spaced chains 100 arranged in continuous loops around sprockets 102. The sprockets 102 are keyed to drive shafts 104 which are rotatably supported in frame side members 105 and driven by suitable motor and drive pulley unit (not shown) in a conventional manner. Dogs 106 projecting at longitudinally spaced intervals along the chains 100 catch the leading edge of the envelope blanks 20 at side flap 32 from a stack held in a suitable dispenser (not shown) and deposit each blank between upper and lower centrally disposed feed belts 108 and 110. The belts 108 and 110 are carried on pulleys 109 and 111 which are mounted on shafts 112 journaled in frame members 105 and driven by the same drive system as chains 100.

The feed belts 108 and 110 grasp the leading edge of one of the flaps 32 and then the medial portion of the first panel 22 to transport each blank 20 along section A with transverse score lines X1, X2 and X3 oriented parallel to the path of travel. Horizontal platens 113 are spaced on each side of the feed belts 108 and 110 to define a table during conveyance of the blanks through the first section A and in addition support the various bending and creasing mechanisms.

Figure 6:
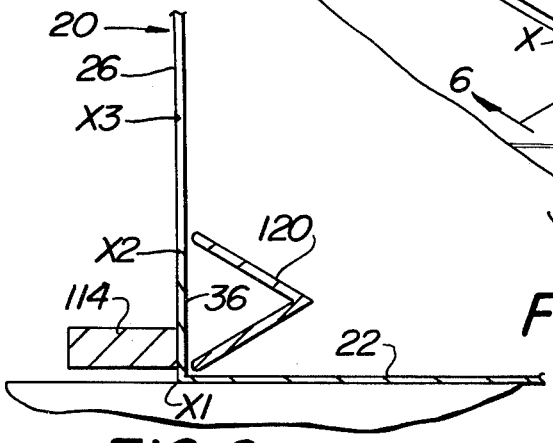
FIG. 6 is a sectional view taken along lines 6—6 of FIG. 5.
Figure 7:
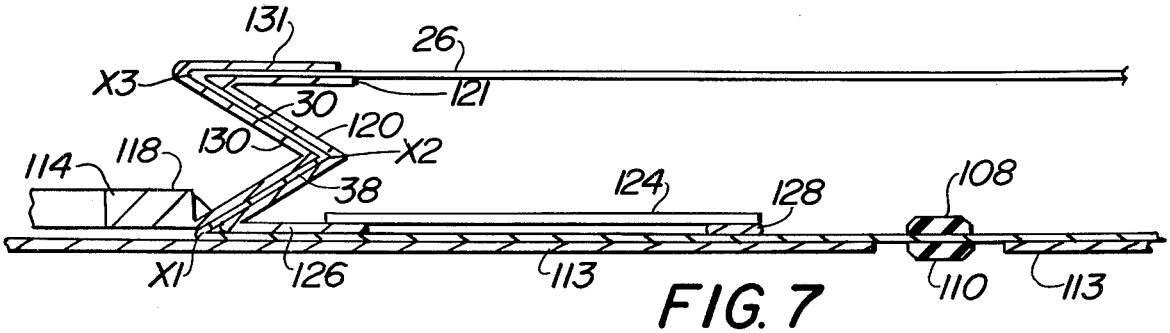
FIG. 7 is a sectional view taken along lines 7—7 of FIG. 5.
Figure 8:
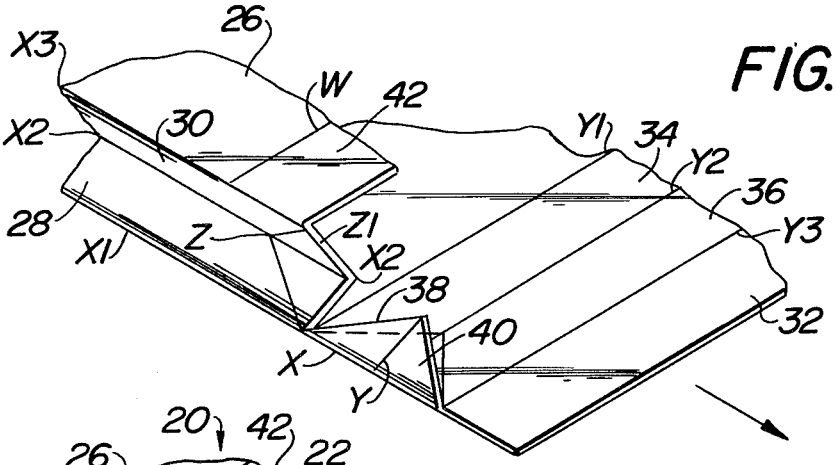
FIG. 8 is a fragmentary perspective view of the envelope blank after initial folding at position 5.

Referring now to FIG. 5, a folding blade 114 upstands from platen 113 directly in the path of travel of corner tabs 38–40 and behind them bottom gusset section 28. The blade 114 includes a pointed horn 116 at its leading edge which is adapted to engage just under the corner flaps 38–40. Then, as the blank 20 is conveyed through section A above platens 113, the blade 114 progressively widens and thickens to curl corner tabs 38–40 upwardly about score line X, and then the second panel 26 upwardly about score line X1. The blade 116 has flattened tail 118 which is spaced above the platen 113 so that a crease is formed along the score lines X and X1 as they pass under the tail. Meanwhile, starting in advance of the tail 118 and spaced inboard thereof in a guide rail 120 which prevents the second panel 26 from falling into parallel disposition with the first panel 22. The guide rail 120 is of angular configuration (sidewise Vee-cross-section) as best shown in FIGS. 5 and 6, and after the slanted leading portion of this rail converges with blade 114 the trailing portion of this guide rail 120 runs in line with the tail 118.

Referring next to FIGS. 1, 5, 6 and 7, the rail 120 is suspended above platen 113 at its forward end by cross beams 122 and 123 and at its rearward end by plate 124. An outboard holddown shoe 126 is formed on the bottom of the trailing portion of rail 120 and is so spaced above the platen 113 as to maintain the lower margin of panel 22 in sandwich disposition therebetween during conveyance of the blanks 20 via belts 108 and 110. Similarly, a pressor foot 128 longitudinally projects down from the other side of place 124 to slidably sandwich the central portion of the blanks in controlled attitude.

Inserted within the trailing portion of rail 120 is a folding guide 130 having a forwardly projecting rib 132 which engages and prevents the panel 26 from rotating outwardly. The guide 130 also has a V-shaped cross-section which is spaced within the "Vee" of rail 120 in complementary disposition. Thus, the bottom gussets 28 and 30 are inwardly folded about scores X1, X2, and X3 as the blank 20 proceeds through this station. At the same time, the rib 132 flares rearwardly into a flat flange 131 which is spaced horizontally above a complementary flange 121 on rail 120. See FIG. 7. Accordingly, the second panel 26 is urged into parallel disposition with the first panel 22.

As the blank 20 progresses longitudinally through the frame section A, the Vee's of the rail 120 and guide 130 flatten out and converge so as to press the gussets 28 and 30 and the second panel 26 into flat disposition with first panel 22.

Referring back to FIG. 1, a series of rollers 138 and 140 take over after the blanks 20 emerge from the first gusset folding station 17 and further press the gussets 28 and 30 into more flattened condition against moving belt 142 therebelow. Thereafter, the blanks 20 pass between ironing rollers 144 which tightly crease all folds preparatory to delivery of the blanks into the transfer section B against an adjustable stop 146 therein. At this stage, the blanks 20 change directio so that they now move in a path parallel to the longitudinal fold line Y1, Y2, and Y3.

In a manner fully illustrated in U.S. Pat. No. 4,016,808, a pair of laterally spaced chains 150 carried by sprockets 152 are driven in a direction perpendicular to the conveying system of section A. Flappers 154 resiliently depend at an angle from overhead truss 156 in spaced disposition above base plate 158 within the transfer section B. See FIG. 1. The drive chain 150 incorporates dogs 151 which are synchronized with each blank 20 deposited against stop 146 so as to move the blank 20 from left to right as shown in FIG. 1. See also the transfer of direction of the blanks from that shown in FIG. 9 in which the blanks move in a longitudinal path down Section A to the transverse direction shown in FIG. 10 wherein the blanks move in a lateral direction through the transfer section B.

Figure 10:
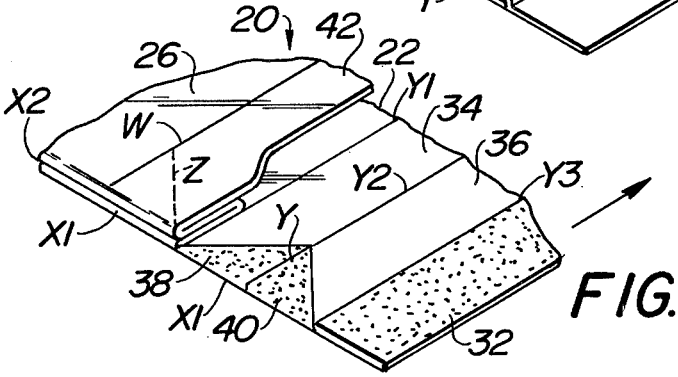
FIG. 10 is a fragmentary perspective view of the envelope blank after emerging from the glue application station 9.
Figure 9:
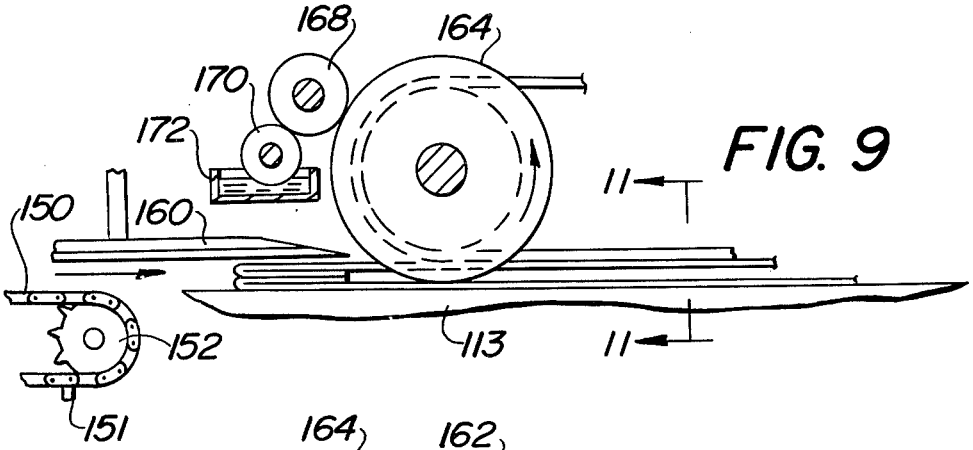
FIG. 9 is a fragmentary side view taken generally at the position designated by the arrow 9 in FIG. 1 and showing the application of glue to the corner tabs and to the side flaps preliminary to final folding of the envelope in the apparatus transfer section.
Figure 11:
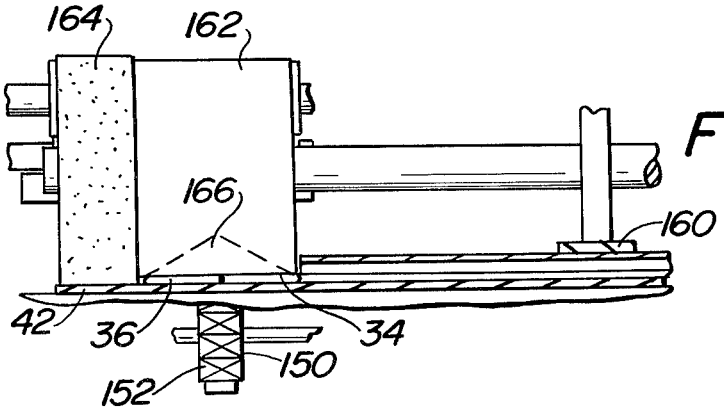
FIG. 11 is a sectional view taken along lines 11—11 of FIG. 9.

Referring now to FIGS. 9, 10, and 11, the dogs 151 push the blanks below a horizontally extending pressor foot 160 which holds down the panel 26 and its folded gussets 28 and 30 while the flaps 32 and triangular tabs 38–40 pass under a glue applicator roller 162. A strip pad 164 on the circumference of roller 162 lays down a seam of cement upon side sealing flap 32 while a triangular pad 166 in synchronized registration with triangular tabs 38–40 lays down a tab of cement on the latter. See FIG. 10. The pads 164 and 166 are tangentially rotated against a glue transfer roller 168 which is in peripheral contact with glue pick up roller 170 emersed in liquid adhesive carried within pot 172.

Figure 13:
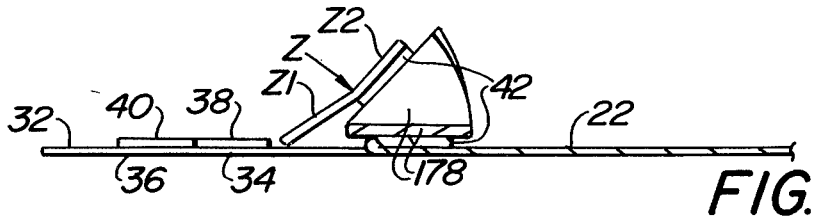
FIG. 13 is a sectional view taken along lines 13—13 of FIG. 12.

Referring next to FIGS. 12 and 13, upper and lower belts 174 and 176, similar to feed belts 108 and 110, transport the blanks 20 by embracing the center of panels 26 and 22 in sandwiched disposition, including the folded gussets 28 and 30 therebetween. A bayonnet blade 180 projecting from bar 178 is suspended from a support (not shown) directly in the path of travel of the break-away flap 42. The bayonnet 180 prys open the flap 42 by engaging thereunder and then flares said flap outwardly about score line W below the bar 178. When the flap 42 is flared open, the triangular portion Z2 moves along with said flap 42 and breaks open along line X2′ as shown in FIG. 12.

When the blanks 20 emerge from the station shown in FIG. 12, wherein the break-away flap 42 has been folded outwardly to expose the triangular portion Z, the portion Z2 is drawn back to place said triangular portion Z in side-by-side disposition with triangular tabs 38–40, the alititude X2′ being parallel with altitude Y. Referring now to FIGS. 14, 15, and 16, a blade 182 with a horn 184, similar to folding blade 114 and its horn 116, is interposed in the path of travel of each of the interior side gusset sections 34. As a result, gusset sections 34, 36 and side flap 32 are caused to inwardly fold on score line Y1 whereby folded down triangular tabs 38–40 with their dabs of cement are urged toward the triangular portions Z which were adjacent thereto. A finger 186 diagonally projects forwardly to catch above the outer gusset section 36 and forces this section into contact with the underlying break-away flap 42. When the finger 186 and the tail portion of blade 182 are over the triangular tabs 38–40, the latter are pressed into sealed engagement with the underlying isosceles triangles Z. In the meantime, a curling blade 188 downwardly suspended by a rod 190 from the upper portion of frame section B and having a toe portion 189 engages underneath sealing flap 32 which has adhesive thereon and prevents said flap from coming into contact with the outer surface of second panel 26.

Referring now to FIG. 16, it may be seen how curling blade 188 maintains the adhesively coated flap 32 from contacting any portion of the envelope blank therebelow. Downstream of the forward ends of the finger 186 (one on each side) is an ironing roller 192 which bears down upon the outside of gusset sections 34 and 36 and presses them together with the now abutting triangles 38–40 and Z sandwich therebetween against ttable plate 158. Next, the curling blade 188 with its diagonal disposition progressively moves inwardly from under flape 32 to under break-away flap 42 causing both to flare open about score lines Y2 and W. See FIG. 17. In this position triangular tab 38 is in overlying sealed engagement with triangle Z2 and tabe 40 is in overlying sealed engagement with triangle Z1, the score lines Y and X2′ effectively forming a single pivotal axis.

Referring now to FIG. 18, the diagonal disposition of the curling blade 188 now causes it to move over the above break-away flap 42. Substantially simultaneously therewith, a creasing and ironing prow 194 enters from the outboard side and catches under the side flap 32. The body of the prow 194 progresses inwardly, as shown in FIG. 19 so as to flare the side flap 32 over and into engagement with the break-away flap therebelow.

Referring now to FIG. 1, a pair of wide belts 196 at the terminal end of the transfer section B press the second panel 26 into flat disposition with the first panel 22 while all gusset sections are in flattened inwardly collapsed disposition. The envelopes are then passed through a dryer (not shown) to cure the adhesive after which the completed envelopes are stacked for storage.

As is apparent from the foregoing description, the present invention is basically concerned with a method and apparatus for fabricating an expansible gusset envelope from a blank in which a pair of panels 22 and 26 are hinged to each other by bottom gusset sections 28 and 30 defined by transverse triple score lines X1, X2, and X3 in combination with flaps 32 hinged to the first panel 22 by side gusset sections 38 and 40 defined by longitudinal triple score lines Y1, Y2 and Y3. Triangular tabs 38 and 40 are hinged to the side gusset sections 34 and 36 along a fold line X registering with the first transverse fold line X1 and hinged to each other along line Y registering with the medial longitudinal score line Y2. At the same time, triangular scores Z1 and Z2 are included at the outside margins of the bottom gusset sections 28 and 30, at the apices of said triangles face inwardly toward each other. Longitudinal score lines W at the outer margins of the second panel 26 define break-away flaps 42. After the second panel is folded inwardly, then outwardly, then inwardly along transverse fold lines X1, X2 and X3 so as to lie in overlying disposition with the first panel 22, and the triangular tabs 38–40 folded outwardly along line X, the break-away panels 42 are folded outwardly to open the triangular portions Z1 and Z2 along score line X2′ so that they are exposed preparatory to tucking in of the triangular portions 38–40. After glue has been applied to the triangular portions 38–40 and to the side sealing flaps 32, said flaps are folded inwardly along the interior longitudinal fold Y1 so that triangles 38–40 are pressed into adhered disposition with triangular portions Z. Thereafter, the side sealing flaps are folded outwardly along line Y2 and then inwardly along line Y3 into sealing engagement with the outer margins of the first panel 22 including the break-away flaps 42. At the same time, the triangular folds Z become outwardly disposed to form an isosceles triangle which comprises a closed gusset corner. At completion of the folding and glueing operations, all gussets are inwardly collapsed between the front and back panels.

Although this invention has been described in considerable detail, such description is intended as being illustrative rather than limiting, since the invention may be variously embodied without departing from the spirit thereof, and the scope of the invention is to be determined as claimed.

I claim:

1. In a machine for fabricating an expansible gusset envelope from a blank having first and second panels hinged to each other along triple transverse fold lines defining inwardly collapsible bottom gusset sections therebetween, scored isosceles triangular portions at the margins of said bottom gusset sections having apices facing each other along the medial transverse fold line, break-away flaps at the margins of said second panel defined by lateral fold lines coextensive with the apices, side flaps hinged to the lateral edges of said first along triple longitudinal fold lines which define inwardly collapsible side gusset sections therebetween, and triangular tabs hinged to the side gusset sections along a line registering with the inboard transverse fold line and hinged to each other along a line registering with the medial longitudinal fold line to define isosceles triangular projections substantially congruent with said scored isosceles triangular portions, apparatus comprising:

(a) bendling means for folding said isosceles triangular projections into overlying disposition with the lower margins of said side gusset sections, and inwardly folding said bottom gusset sections so that said second panel is in overlying disposition with said first panel, (b) flaring means for outwardly folding said break-away panels along the lateral fold lines so that the isosceles triangular portions break open and are in exposed side-by-side disposition with the isosceles triangular projections (c) means for folding said flaps so that the isosceles triangular projections are adhesively secured to said isosceles triangular portions (d) curling means for outwardly then inwardly folding said side flaps along the medial and outboard fold lines and adhesively securing said side flaps to the outer margins of said second panel, wherein all gusset sections are inwardly collapsed with doged corners.

2. The apparatus of claim 1 including conveying means for transporting the blanks along a path parallel to the transverse fold lines during inward folding of said bottom gusset sections.

3. The apparatus of claim 2 including second conveying means for transporting the blanks along a path parallel to the longitudinal fold lines during inward folding of said side gusset sections.

4. The apparatus of claim 2 wherein said bending means comprises a longitudinally extending rail of Vee-shaped cross section and a V-shaped blade in complementary spaced therewith.

5. The apparatus of claim 3 including ironing means to press said bottom gusset sections together.

6. The apparatus of claim 3 wherein said flaring means comprises a toe portion for engagement under said break-away flaps and a flattened curling portion for urging said break-away flaps into face to face disposition with said first panel.

7. The apparatus of claim 6 including rollers for applying strips of glue to said side sealing glaps and dabs of glue to said isosceles triangular projections.

8. The apparatus of claim 7 wherein said curling means includes a finger for engaging under said break-away flap and curling said outboard gusset sections outwardly along the medial longitudinal fold line, and a rail portion for curling said side sealing flaps into flat ironed positioned against said breakaway flaps.

9. A method for fabricating an expansible gusset envelope from a blank having: first and second panels hinged to each other along triple transverse fold lines which define bottom gusset sections therebetween, diagonal fold lines at the margins of said bottom gusset sections forming scored isosceles triangular portions having apices facing each other along the medial transverse fold, including breakaway flaps at the margins of said second panel defined by lateral fold lines coextensive with the apices, said flaps hinged to the lateral edges of said first panel along triple longitudinal fold lines which define side gusset sections therebetween and triangular tabs hinged to the side gusset sections along a line registering with one inboard transverse fold line and hinged to each other along a line registering with the medial longitudinal fold line to define isosceles triangular projections substantially congruent with said scored isosceles triangular portions, comprising the steps of:

(a) folding the isosceles triangular projections into overlying disposition with the lower margins of said side gusset sections.

(b) folding said bottom gusset sections inwardly and said second panel into overlying disposition with said first panel, (c) folding said breakaway flaps outwardly along the lateral fold lines thereof to break open said scored isosceles triangular portions into exposed side-by-side disposition with said isosceles triangular, (d) folding said side gusset sections inwardly along the first longitudinal folds and adhesively securing said isoceles triangular projections to said isosceles triangular portions, (e) folding said side flaps outwardly along the medial longitudinal folds inwardly along the third longitudinal folds and adhesively securing said side flaps to the margins of said second panel whereby all gusset sections are inwardly collapsed with closed gusset corners.

* * * * *